United States Patent [19]

Yanai

[11] 4,352,657

[45] Oct. 5, 1982

[54] LIGHTING DEVICE

[76] Inventor: Taro Yanai, No. 3-13, Shirakawa 1-chome, Koto-ky, Tokyo, Japan

[21] Appl. No.: 163,911

[22] Filed: Jun. 27, 1980

[30] Foreign Application Priority Data

Dec. 28, 1979 [JP] Japan ..... 54-182674[U]

[51] Int. Cl.[3] ..... F23Q 2/32

[52] U.S. Cl. ..... 431/127

[58] Field of Search ..... 431/127

[56] References Cited

U.S. PATENT DOCUMENTS

| | | | |
|---|---|---|---|
| 1,981,022 | 11/1934 | Ayotte | 431/127 |
| 2,019,382 | 10/1935 | Aronson | 431/127 |
| 2,267,825 | 12/1941 | Harris | 431/127 |
| 3,930,785 | 1/1976 | Yanai | 431/127 |

*Primary Examiner*—Carroll B. Dority, Jr.
*Attorney, Agent, or Firm*—McGlew and Tuttle

[57] ABSTRACT

The invention comprises a soft metal lighting rod having its tubular part threaded, into which the lower part having the same material as the threaded part is fitted with such tightness as to permit rotation, with the lighting rod screwed into the case body being adjusted to render the extended tip of a wick to directly contact with the surface of the undercut portion of absorbent material, thus, keeping the absorption of fuel sufficient and consistent, permitting quick lighting when being abraded, providing equal flame size at every use and at the same time, making possible initial installation and replacement of the wick with ease by removing the lower part from the threaded part of the lighting rod.

4 Claims, 4 Drawing Figures

LIGHTING DEVICE

BACKGROUND OF THE INVENTION

In the conventional lighter having a soft metal lighting rod, the lower part of which is extended and fitted into itself with an abrasive steel strip, on both sodes of which is contained a lighting wick, especially of such a type that a lighting rod is screwed into a thin case body, there have been disadvantages in that the quick lighting of the wich is not obtained when a lighting rod is abraded against a flint for ignition, flame size after ignition varies at every use. One of the reasons for the above-mentioned drawbacks may be that the contact of the lighting wick with the fuel absorbent material in the case becomes poor, or the lighting wick is prevented from being in direct contact with the absorbent material, thus rendering its absorption of fuel insufficient as well as inconsistent. Another disadvantage arises from the closed upper end feature of the lighting rod, in which the lighting wick is contained, rendering the initial installation and replacement of the lighting wick inconvenient.

BRIEF SUMMARY OF THE INVENTION

The object of the present invention is to provide a lighting device which is capable of:

(a) make the absorption of fuel by the lighting wick sufficient and consistent;

(b) obtain quick ignition when being abraded;

(c) maintain a constant flame size at every use; and (d) facilitate the initial installation and replacement of the lighting wick with ease.

DETAILED DESCRIPTION OF THE INVENTION

An embodiment of the invention will now be described referring to the accompanying drawings.

Figure 1:
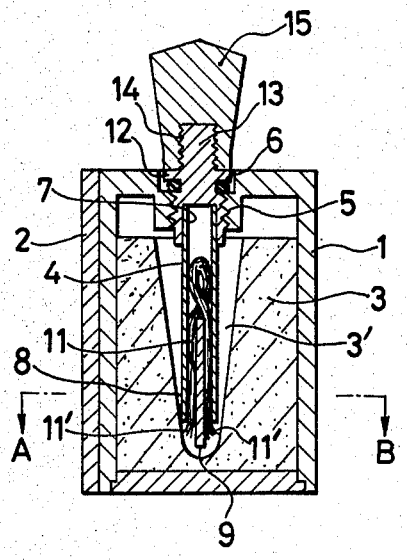
FIG. 1 is an elevational view of the overall longitudinal section of an embodiment of the lighter according to the invention.
Figure 2:
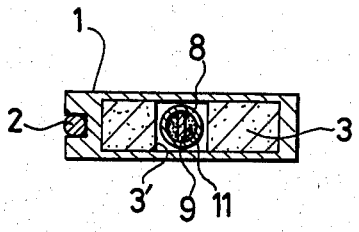
FIG. 2 is a plan view of a transverse section on Line A–B of FIG. 1.
Figure 3:
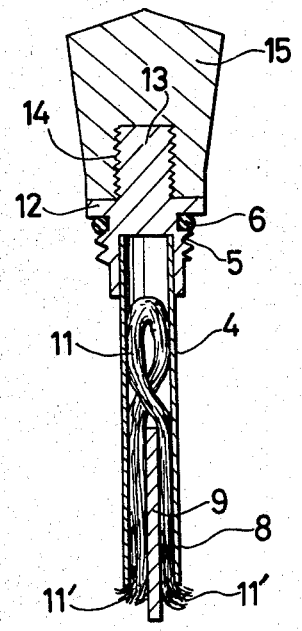
FIG. 3 is an enlarged elevational view of a longitudinal section of the lighting rod.

FIG. 1 shows a case 1 having a rectangular body of thin thickness, wherein a flint 2 is installed on one side, the absorbent material of felt dampened with benzine being filled therein, with the bronze lighting rod 4 being screwed in from the top of the case 1 so that the tip of the rod 4 is directed toward the bottom of the V-shaped undercut 3' made in the center portion of the absorbent material.

The lighting rod 4 is fitted with an O-ring at the upper end of its threaded part 5 and is adapted to seal the inside of the case 1, while the threaded part 5 has a cylindrical portion, wherein the top end of the lower part 8 made of a bronze tube of the same material as the lighting rod 4 is fitted with such tightness as to permit rotation.

In the bottom of the lower part 8 is fitted the abrasive steel strip 9 made of hard steel plate, with its protruded claws 10 engaged in the inner wall of the lower part 8, wherein the lighting wick 11 is contained on both sides of the abrasive steel strip 9, with the exposed end 11' of the wick 11 being extended to the outside of either side of the bottom end of the lower part 8.

An attaching head 13 is integrally formed on a flange 12 of the top of the threaded part 5 and is knurled on the surface 14 thereof to be press-fitted with a large knob 15 of synthetic resin. The head 13 and the knob 15 are tightly put together, enabling the lighting rod 4 to be screwed in forcefully and easily and, at the same time, shielding the heat from the flame of the lighting rod 4.

In the case 1 having thin thickness, the wearing of the threaded parts or the variation of flexibility of filled material results from the long time use of a lighting device, causing the displacement of the contact points of the extention 11' of the lighting wick 11 against the V-grooved surface 3' of the absorbent and rendering their contact poor.

Figure 4:
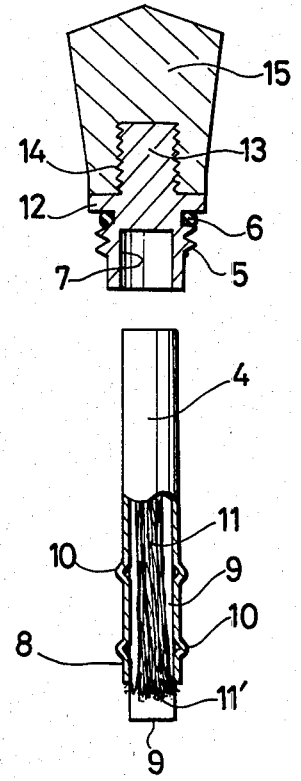
FIG. 4 is a side view of the longitudinal section of the lighting rod in a separated condition.

The invention, having the aforementioned construction, provides such practical advantage that using the same material on the circular tube 7 and the lower part 8 makes the expansion deformation small due to the flame heat, thereby keeping the tightness of fit constant for a long time and when the contact points between the wick extension 11' and the V-groove 3' are to be adjusted, the correct position of the extension 11' is easily obtained by rotating the knob 15 slightly with due attention paid to the screw lead-in of the thread 5. Furthermore, another advantage is realized in that the lower part 8 can be removed from the circular tube 7, as shown in FIG. 4, permitting the insertion and removal of ignition wick 11 from the opening of the top of the lower part 8.

What is claimed is:

1. A lighter comprising a case having a fuel absorbent therein adapted to be saturated with a fuel, said fuel absorbent having a lighter rod access undercut therein, said case having a threaded opening overyling the undercut, a lighter rod assembly including a fitting portion having a radially outwardly extending flange defined around its periphery and a threaded portion below said flange threadably engaged in said threaded opening of said case, said fitting portion having a bottom face with a cylindrical lighting rod receiving recess, a tubular lighting rod having a bottom opened end and a top end press-fitted into the cylindrical lighting rod recess and adapted to extend into the undercut, an abrasive strip press-fitted into the open end of said lighting rod, a wick folded over said abrasive strip on the interior end thereof and extending out of the bottom end of said lighting rod on each side of said strip, and a knob press-fitted onto said fitting portion above the flange thereof.

2. A lighter according to claim 1, wherein said case includes a top face with a recess therein and an O-ring disposed between said flange portion of said fitting and said case in the recess.

3. A lighter according to claim 1, wherein said case has an exterior wall with a flint thereon.

4. A lighter according to claim 1, wherein the exterior of said fitting portion above said flange is provided with a knurling, said knob having a bottom face with a blind bore defined therein engageable over the knurling of said fitting portion.

* * * * *